US006843318B2

(12) United States Patent
Yarbro

(10) Patent No.: US 6,843,318 B2
(45) Date of Patent: Jan. 18, 2005

(54) METHOD AND SYSTEM FOR DETERMINING THE POSITION AND ORIENTATION OF A DEVICE IN A WELL CASING

(75) Inventor: Gregory S. Yarbro, Casper, WY (US)

(73) Assignee: Halliburton Energy Services, Inc., Houston, TX (US)

( * ) Notice: Subject to any disclaimer, the term of this patent is extended or adjusted under 35 U.S.C. 154(b) by 97 days.

(21) Appl. No.: 10/411,591

(22) Filed: Apr. 10, 2003

(65) Prior Publication Data

US 2004/0200083 A1 Oct. 14, 2004

(51) Int. Cl.[7] ..... E21B 43/117; E21B 47/024

(52) U.S. Cl. ..... 166/255.2; 166/55.1; 166/66.5; 166/297; 175/4.51

(58) Field of Search ..... 166/255.2, 66.5, 166/55.1, 297; 175/4.51

(56) References Cited

U.S. PATENT DOCUMENTS 3,182,724 A * 5/1965 Shore ..... 175/4.52
3,704,749 A * 12/1972 Estes et al. ..... 166/255.2
3,964,553 A * 6/1976 Basham et al. ..... 175/4.51
5,105,546 A * 4/1992 Weise et al. ..... 33/203.12
5,720,344 A * 2/1998 Newman ..... 166/253.1
6,003,599 A * 12/1999 Huber et al. ..... 166/255.2
6,032,729 A * 3/2000 Nishishita et al. ..... 165/153
6,076,268 A * 6/2000 Fuhr ..... 33/304
6,173,773 B1 * 1/2001 Almaguer et al. ..... 166/255.2
6,378,607 B1 * 4/2002 Ryan et al. ..... 166/255.2

* cited by examiner

*Primary Examiner*—Hoang Dang
(74) *Attorney, Agent, or Firm*—Baker Botts L.L.P.

(57) ABSTRACT

A method and system for activating a device at a particular orientation in a casing are disclosed. The casing has a bias, for example a lower side due to tilt, that defines a default angle in the casing, for example a point along a wall of the casing where objects will rest due to gravity. The method includes providing a magnetic sensor at a known angle in the device relative to the angle at which a device function occurs. For example, the angle at which a perforating gun perforates the casing is a device function angle. The method further includes lowering the device into the casing. The method further includes determining the offset of the device from the casing at the known angular position from an output of the magnet sensor. The device can then be activated.

24 Claims, 13 Drawing Sheets

METHOD AND SYSTEM FOR DETERMINING THE POSITION AND ORIENTATION OF A DEVICE IN A WELL CASING

BACKGROUND

The present invention relates to the field of operating devices inserted inside casings of hydrocarbon wells. In particular, the invention relates to a method and system for position and orientation of a device relative to a well.

After hydrocarbon wells are drilled a completion process includes the placement of a metal casing (often made of steel) inside the borehole. Devices can then be lowered into the well inside of the casing. Some devices have a function that is dependent on the radial angle that the device faces when the function is performed. For example, a perforating gun is a device that can be lowered into a casing to perforate the casing (as well as the cement holding the casing in place and the surrounding formation). In some circumstances, perforations in a particular direction are advantageous. One circumstance would be in hydraulic fractured wells where injection pressures can be reduced and flow rates increased if the perforating holes are aligned with the direction of principal maximum stress. Another circumstance would be in wells that include sensors and communication lines where perforations in a particular direction could damage the other equipment. A second example device would be a sensor that receives information dependent on the angle that it is facing. Being able to determine the facing angle of the device assists the well operator in deciding whether the device should be activated.

SUMMARY

In general, in one aspect, the invention features a method for measuring the orientation of a device in a casing. The casing has a bias, for example a lower side due to tilt, that defines a default angle in the casing, for example a point along a wall of the casing where objects will rest due to gravity. The method includes providing a magnetic sensor at a known angle in the device relative to the angle at which a device function occurs. For example, the angle at which a perforating gun perforates the casing is a device function angle. The method further includes lowering the device into the casing. The method further includes determining the offset of the device from the casing at the known angular position from an output of the magnet sensor.

In general, in another aspect, the invention features a perforating gun. The perforating gun includes a perforation device that is aimed to perforate the casing at a particular angle. The perforating gun also includes a magnetic sensor that is positioned at a known angle relative to the angle at which the perforation device is aimed. The perforating gun also include a magnet that is positioned in the gun sufficiently proximate the magnetic sensor to bias the sensor.

In general, in another aspect, the invention features a method of perforating a casing. A magnetic sensor is provided at a known angle to the perforation angle in a perforating gun. The perforating gun is lowered into the casing. The casing has a bias, for example a lower side due to tilt, that defines a default angle in the casing, for example a point along a wall of the casing where objects will rest due to gravity. The distance between the gun and the casing at the magnetic sensor is determined from an output of the magnetic sensor. The casing is perforated at the perforation angle. In one implementation, the perforating gun is rotated after the distance between the gun and casing at the magnetic sensor is determined.

Implementations of the invention may include one or more of the following. The magnetic sensor can be a GMR field sensor, a Hall effect device, and a magnetometer among others. Additional magnetic sensors can be used. The device can have additional functions that occur and the same angle or different angles. The device can have additional functions that are angle independent.

DETAILED DESCRIPTION

Figure 1:
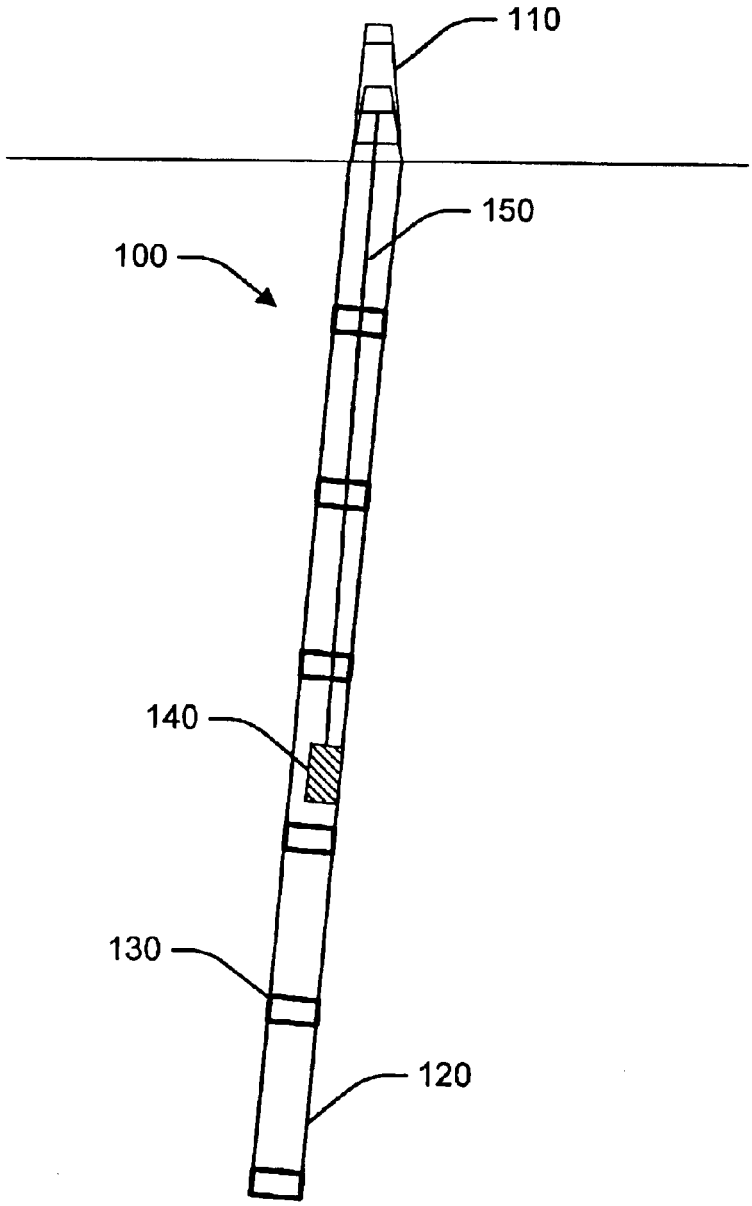
FIG. 1 is an illustration of a borehole in one implementation of the invention.

A borehole 100 is shown in FIG. 1 extending into the ground from a wellhead structure 110. After the borehole 100 has been drilled, a completion process includes placing a casing including sections of casing 120 and casing collars 130 in the borehole 100. A device 140 can then be lowered into the casing at the end of a cable 150. If the device 140 utilizes an electrical connection, for example various perforating guns use an electrical connection, the cable 150 can be an electromagnetic cable. An electromagnetic cable can be un-balanced in that the inner armor and outer armor of the logging cable can have different strengths. A device suspended by an un-balanced cable can spin as a result of torque generated when the tension is altered on the cable. Changing the amount of cable from which the device is suspended can modify the tension causing the device to spin.

The borehole 100 is oriented at a slight angle compared to the vertical. At any given point along the borehole 100, one point on the casing is lowest and one point is highest. Gravity tends to bias a device 140 placed in the borehole 100 to rest against the lowest point. In general, a borehole 100 with a greater angle deviation from the vertical will have a greater bias toward the low point for devices 140 at rest therein.

Figure 2:
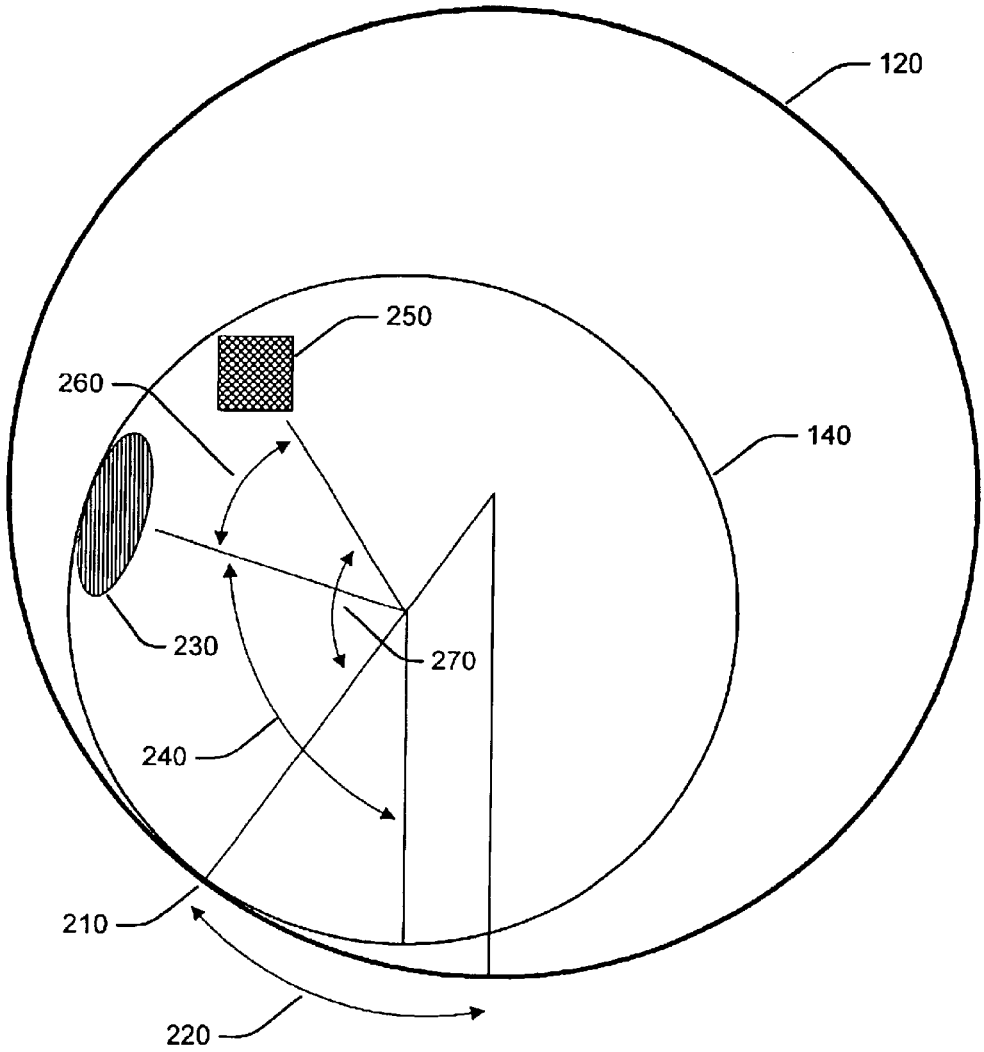
FIG. 2 is radial cross section of the borehole in one implementation of the invention.

FIG. 2 illustrate a radial cross section of the borehole 100. The casing 120 surrounds the device 140. In one implementation, the casing 120 is not vertical and the point 210 of the casing 120 to which the device 140 is biased is the low point of the casing 120. In other implementations, the bias may be different than gravity so that the bias point 210 is not the low point. The low point 210 is at a certain angle 220 from a reference point. If the reference point is chosen as the low point 210 then the angle to which the device is biased is zero.

The device 140 can include a functional unit 230 that is oriented at a particular angle 240. If the device 140 is a perforating gun, then the functional unit 230 can be a perforating charge that can be activated to perforate the casing 120, any cement, and the surrounding formation in the angle 240 of orientation. The outer diameter of the device 140 is less than the inner diameter of the casing 120. The distance between the functional unit 230 and the casing 120 depends on both the difference in the two diameters and the difference between the bias point angle 220 and the function angle 240. If the device 140 is a perforating gun, then the function angle 240 is the perforation angle.

The device 140 can also include a magnetic sensor 250. The magnetic sensor 250 is located at a known angle 260 with respect to the functional unit 230 that does not change as the device spins in the casing 120. As with the functional unit 230, the distance between the magnetic sensor 250 and the casing 120 is partly based on both the angle 270 between the magnetic unit 250 and the bias point 210 and the difference between the inner diameter of the casing 120 and the outer diameter of the device 140. The distance between the device 140 and the casing 120 at a particular angle is also referred to as the offset. For a particular device 140 in a particular casing 120 the difference in diameters is known and, therefore, a mathematical relationship exists between the offset distance at the magnetic sensor 250 and the angle 270 between the magnetic sensor 250 and the bias point 210. By determining the offset, the angle 270 can be determined. In combination, angles 260 and 270 determine the angle between the functional unit 230 and the known bias point 210 so that a well operator receiving a measurement of the offset at the magnetic sensor 250 can determine the orientation of the functional unit 230 and the distance of the functional unit 230 from the casing 120.

In one implementation, the functional unit 230 is a perforating charge and the well operator desires to activate the charge to perforate the casing 120 in a particular direction. If the angle of that particular direction is known relative to the low point 210, the measurement of offset at the magnetic sensor can be used to calculate whether the perforating charge 230 is correctly oriented. If the measurement indicates that the correct angle has not been achieved the device can be raised or lowered to induce spin to the correct angle. Alternatively, equipment that allows the device to be rotated without a change in depth can be used to achieve the proper angle, which is confirmed by the reading of the offset at the magnetic sensor 250 and the subsequent calculation.

Figure 3A:
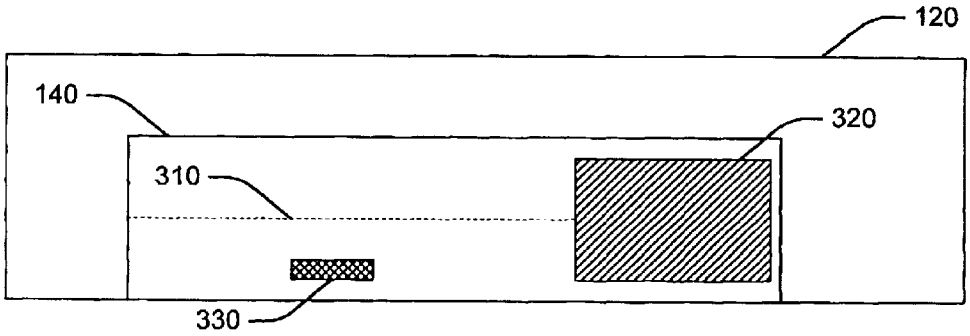
FIG. 3A is a portion of an axial cross section of the borehole in one implementation of the invention.

FIG. 3A depicts a portion of an axial cross section of the casing 120. The portion shown includes the device 140. The device is cylindrical with a center axis 310. Included in the device is a magnetic sensor 330. The magnetic sensor 330 operates to detect magnetic characteristics or changes in magnetic characteristics. For example, a Giant Magneto-Resistive (GMR) device measures magnetic field strength based on a conductor that changes resistance based on the magnetic field that is present. Other magnetic sensors include but are not limited to magnetometers and Hall effect devices. Magnetic sensors can have an axis of sensitivity. If a magnetic characteristic is a vector quantity, for example a magnetic field has both direction and strength, only the portion of that characteristic along the axis of sensitivity will be measured. A magnetic field that is perpendicular to the axis of sensitivity of a GMR device, for example, will not be detected.

The magnetic sensors in FIGS. 3A–F are shown as rectangles and the axis of sensitivity is presumed to be the long axis. The device 140 in FIG. 3A also includes a magnet 320. The magnet 320 can be either a permanent magnet or a temporary magnet. The magnet has north and south poles and in one implementation, each of the poles lie on the center axis 310. The axis through the poles of the magnet 320 is therefore parallel to the axis of sensitivity of the magnetic sensor 330. The magnet 320 biases the magnetic sensor 330 so that changes in measurement induced by changes in the offset to the magnetic material in the casing 120 are in a measurable range. A more powerful magnet 320 does not need to be as close to the magnetic sensor 330 to provide the appropriate bias.

Figure 3B:
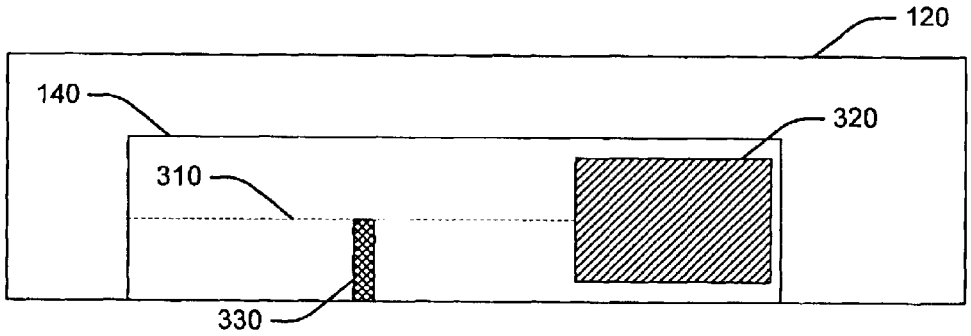
FIG. 3B is a portion of an axial cross section of the borehole in one implementation of the invention.
Figure 3C:
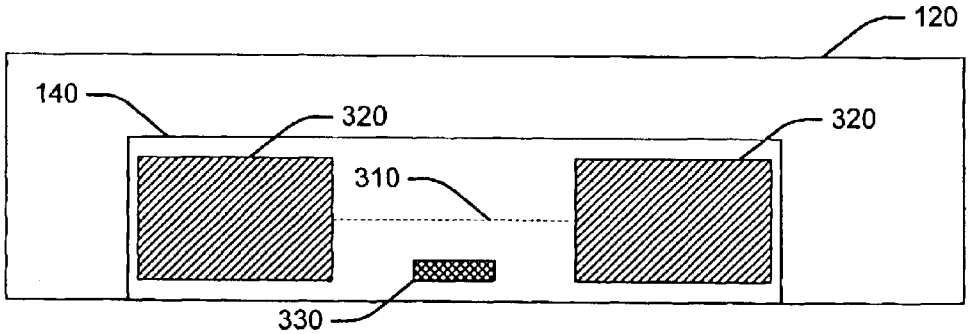
FIG. 3C is a portion of an axial cross section of the borehole in one implementation of the invention.
Figure 3D:
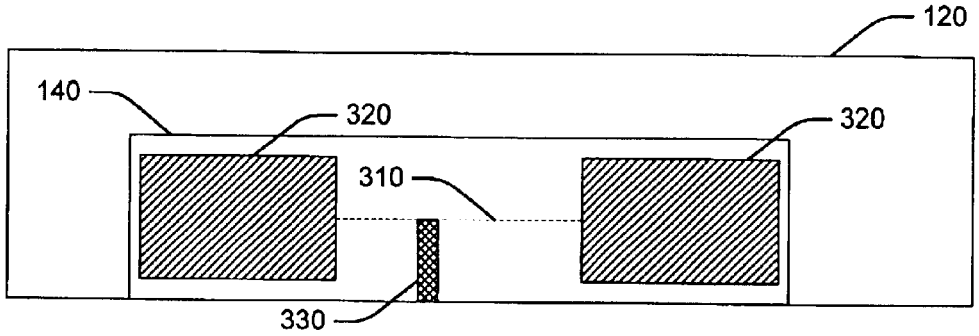
FIG. 3D is a portion of an axial cross section of the borehole in one implementation of the invention.

FIG. 3B depicts a portion of an axial cross section of the casing 120. In this implementation, the magnetic sensor 330 has a different orientation than in FIG. 3A. Instead of having an axis of sensitivity that is parallel to the pole axis of the magnet 320. The axis of sensitivity is now perpendicular to that magnet axis. FIG. 3C depicts an implementation with a parallel axis of sensitivity, but with two magnets 320 aligned with the center axis 310. Two magnets could be used in place of one more powerful magnet to provide appropriate bias to the magnetic sensor 330. FIG. 3D depicts a two magnet configuration with the axis of sensitivity perpendicular to the center axis.

Figure 3E:
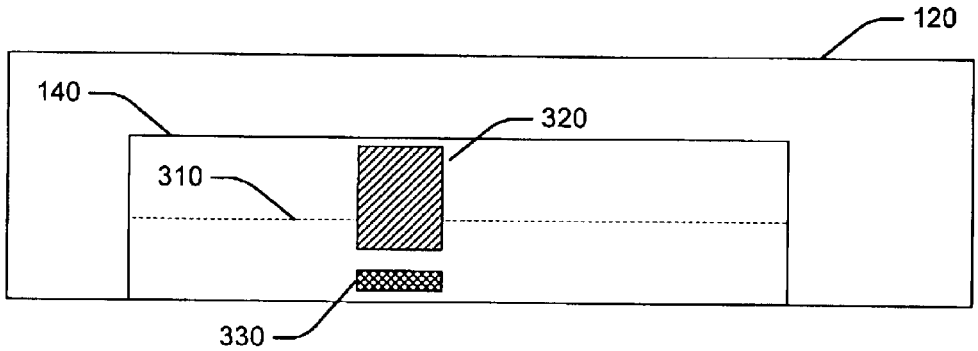
FIG. 3E is a portion of an axial cross section of the borehole in one implementation of the invention.
Figure 3F:
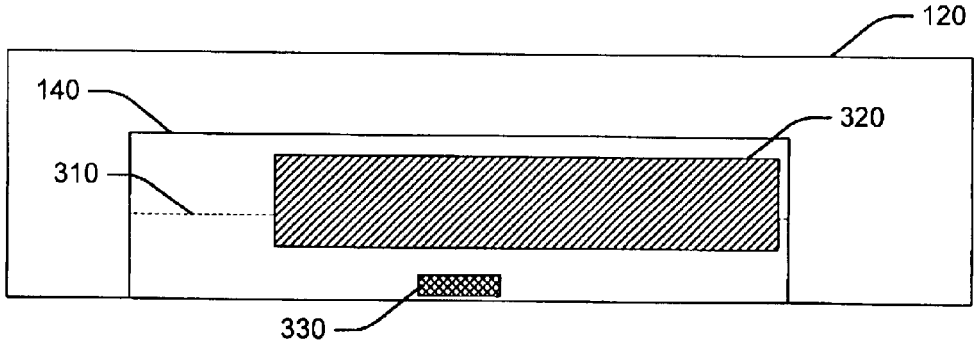
FIG. 3F is a portion of an axial cross section of the borehole in one implementation of the invention.

FIG. 3E depicts a magnet 320 that does not have poles located on the center axis. The poles of the magnet 320 are located on an axis that is perpendicular to the center axis 310. The axis of sensitivity of the magnetic sensor 330, however, is still parallel to the center axis. FIG. 3F depicts a configuration in which the poles of the magnet 320 are located on an axis that is parallel to the center axis 310. The axis of sensitivity is also parallel to the center axis 310. In each of FIGS. 3A–F, the magnetic sensor 330 detects changes in the magnetic characteristic induced by the one or more magnets 320 as the magnetic material that forms the casing 120 (often steel) approaches and withdraws depending on the rotational movement of the device 140.

Figure 4A:
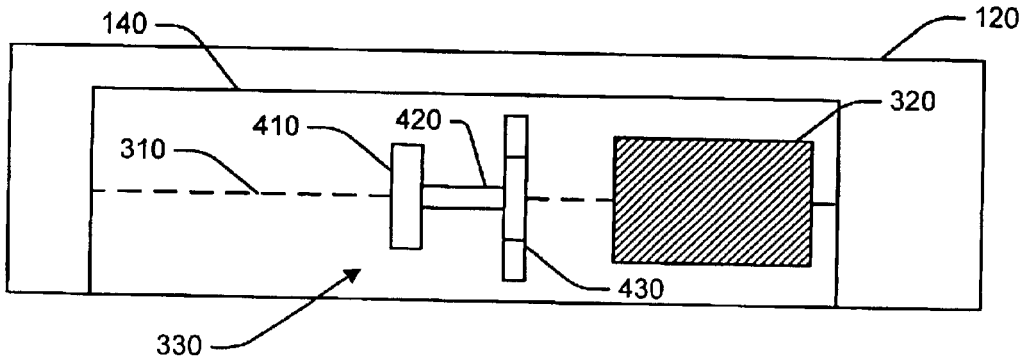
FIG. 4A is a portion of an axial cross section of the borehole in one implementation of the invention.

FIG. 4A depicts a portion of an axial cross section of the casing 120. In this embodiment, the magnetic sensor 330 includes a wheel 430, a shaft 420, and a potentiometer 410.

Figure 4B:
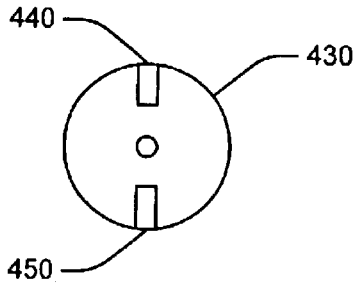
FIG. 4B is a radial cross section of a magnetic sensor in one implementation of the invention.

The magnetic sensor is located on the center axis 310, but contains magnetic elements at a particular angle as shown in FIG. 4B. The wheel 430 includes, in this embodiment, two magnets 440 and 450 at particular angles. Each magnet acts as a sensor and the potentiometer 410 detects the radial changes in the wheel 430 position. Therefore, the magnets 440 and 450 are at a known angle relative to the functional angle of the device 140.

Figure 5:
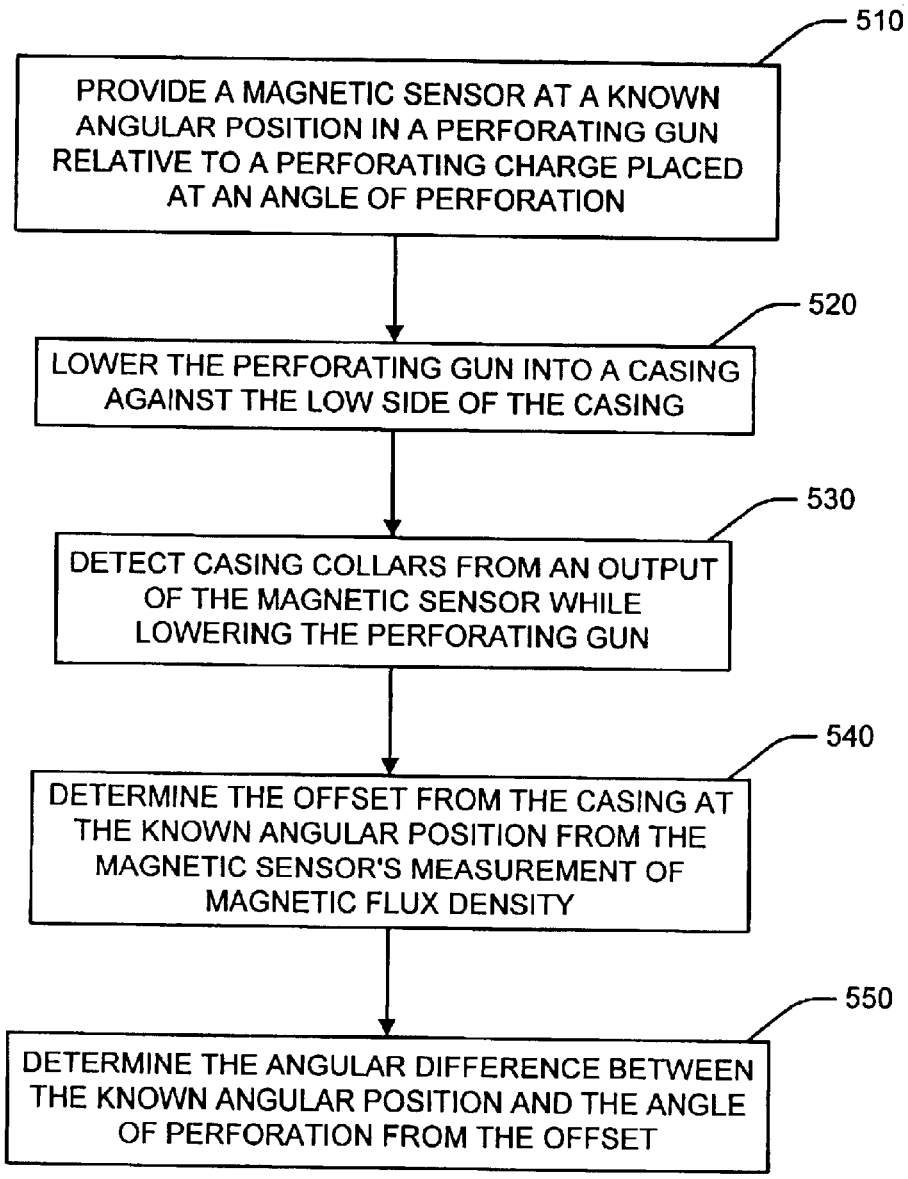
FIG. 5 is a flowchart of a method for measuring the orientation of a device in a casing in one implementation of the invention.

FIG. 5 is a flowchart of a method for measuring the orientation of a device in a casing in one implementation of the invention. A magnetic sensor is provided at a known angular position in a perforating gun relative to a perforating charge placed at an angle of perforation 510. The perforating gun is lowered into a casing against the low side of the casing because of a bias caused by gravity 520. Casing collars are detected from an output of the magnetic sensor while the perforating gun is being lowered into the casing 530. The magnetic sensor output changes based on casing wall thickness and the casing collar has a different thickness than the casing sections. The corresponding changes in output can be used to determine when a casing collar is being passed during the lowering process. The offset from the casing at the known angular position is determined from the magnetic sensor's measurement of magnetic flux density 540. The angular difference between the known angular position and the angle of perforation is determined from the offset 550.

Figure 6:
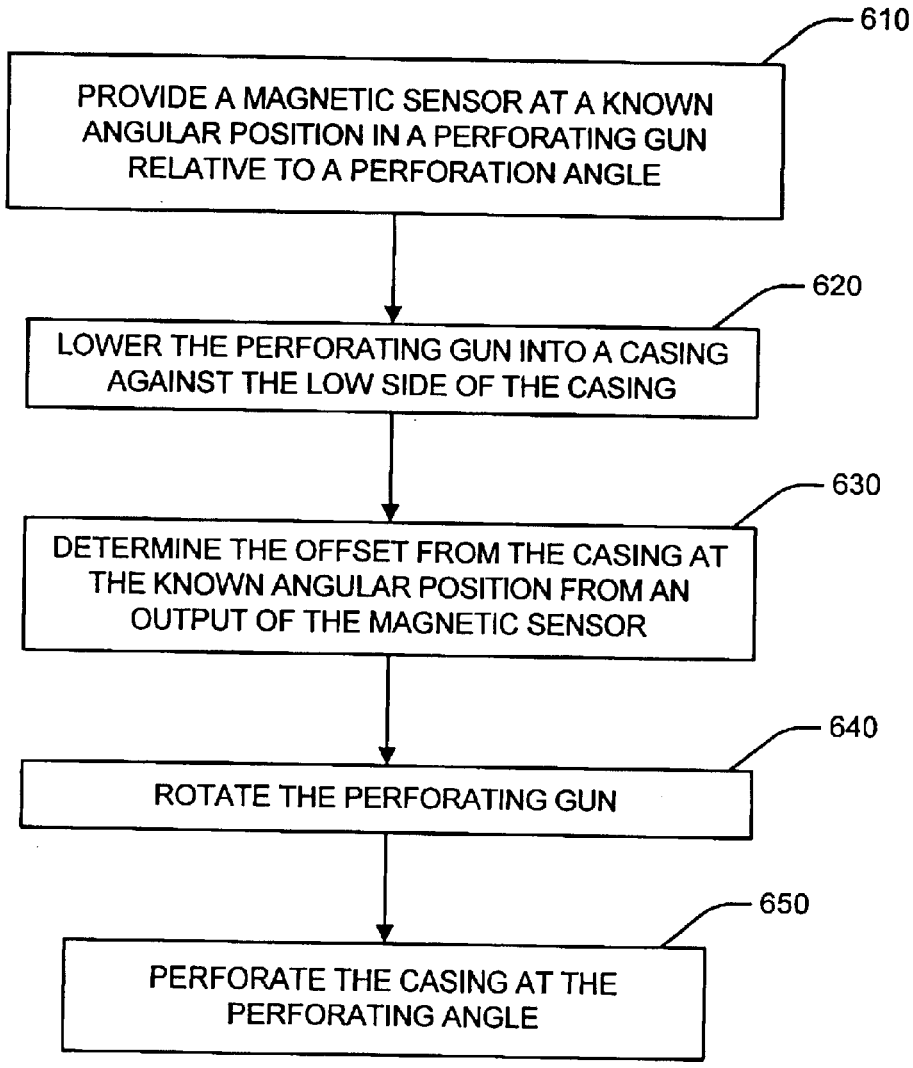
FIG. 6 is a flowchart of a method for perforating a casing in one implementation of the invention.

FIG. 6 is a flowchart of a method for perforating a casing in one implementation of the invention. A magnetic sensor is provided in a perforating gun at a known angular position relative to a perforation angle 610. The perforating gun is lowered into a casing against the low side of the casing 620. The offset from the casing at the known angular position is determined from an output of the magnetic sensor 630. The perforating gun is rotated 640. The casing is perforated at the perforating angle 650.

Figure 7:
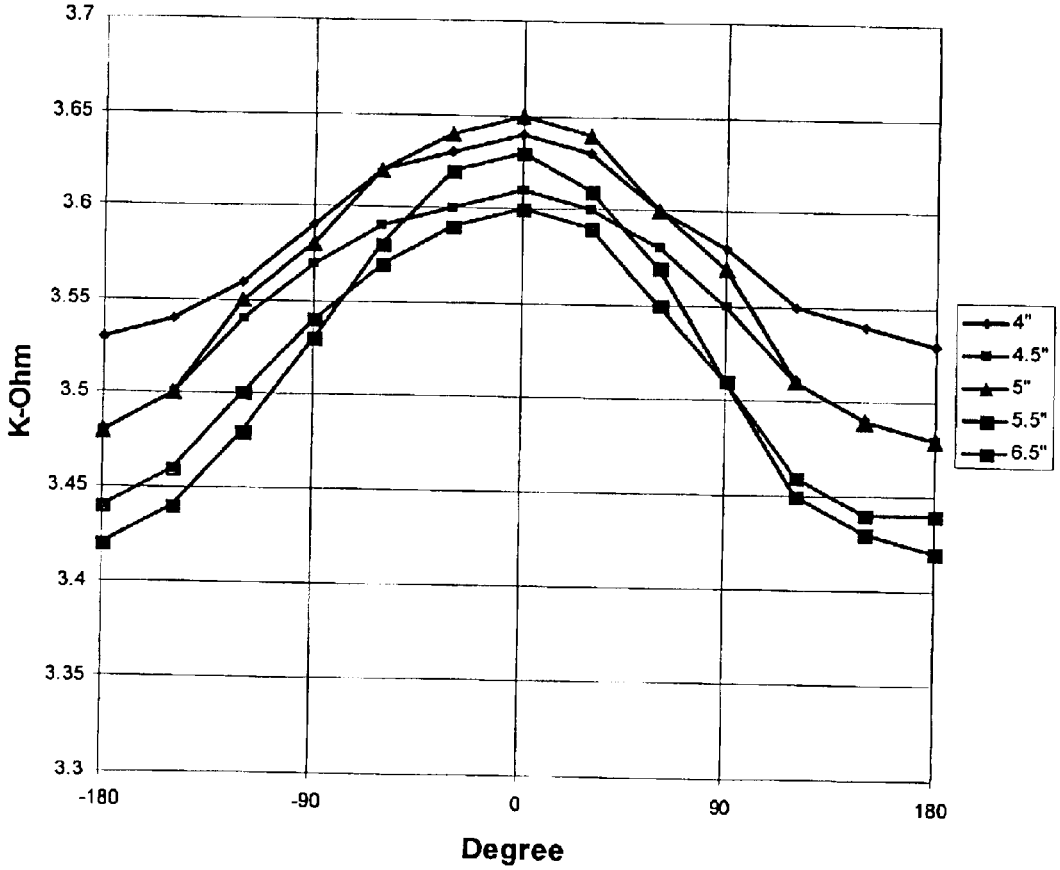
FIG. 7 is a chart showing measurements for different orientations of a device with a magnetic sensor in several different casings.

FIG. 7 is a chart showing measurements for different orientations of a device with a magnetic sensor in several different casings. A GMR was mounted inside a device along with a magnet. The sensitivity axis of the GMR was parallel to the center axis of the device. The device was then rotated inside casings with different internal diameters and measurements of the GMR readings were taken every thirty degrees. Each line in FIG. 7 shows the measurements at each angle for a given casing size. The zero angle is set for the orientation where the GMR is mounted at the angle in the device with no offset from the casing. As the offset between the casing and the device (at the angle where the GMR is mounted) increases, the resistance of the GMR decreases. This relationship allows a calculation based on the resistance value of that offset. The data shown in FIG. 7 is just one example of the many possible implementations of the invention.

Figure 8:
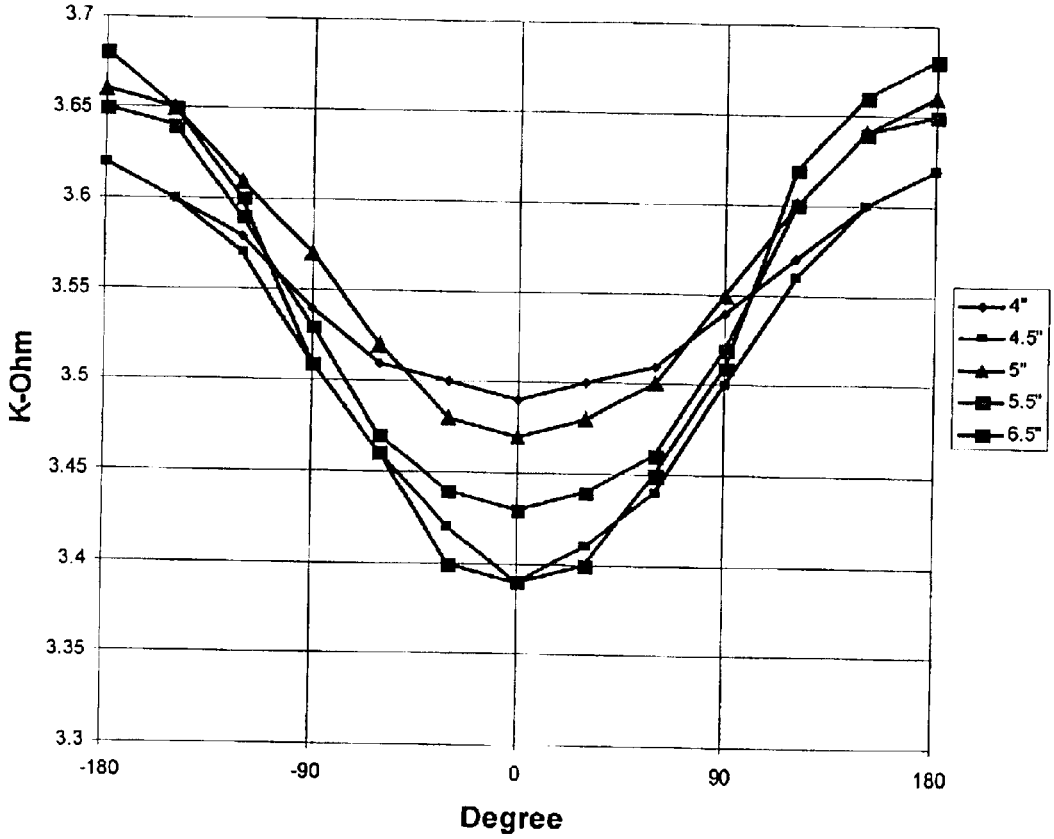
FIG. 8 is a chart showing measurements for different orientations of a device with a magnetic sensor in several different casings.

FIG. 8 is a chart showing measurements for different orientations of a device with a magnetic sensor in several different casings. The arrangement is similar to FIG. 7 except that the GMR is mounted with its axis of sensitivity perpendicular to the center axis of the device rather than parallel. The data shows the resistance of the GMR increasing as the offset increases.

Figure 9:
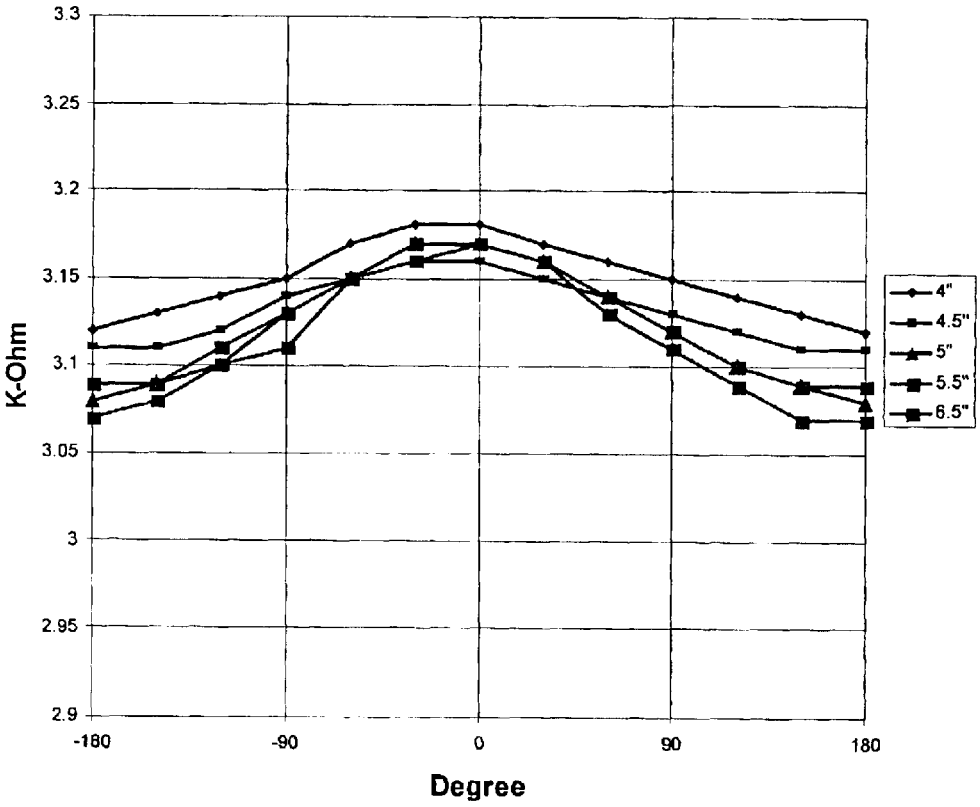
FIG. 9 is a chart showing measurements for different orientations of a device with a magnetic sensor in several different casings.
Figure 10:
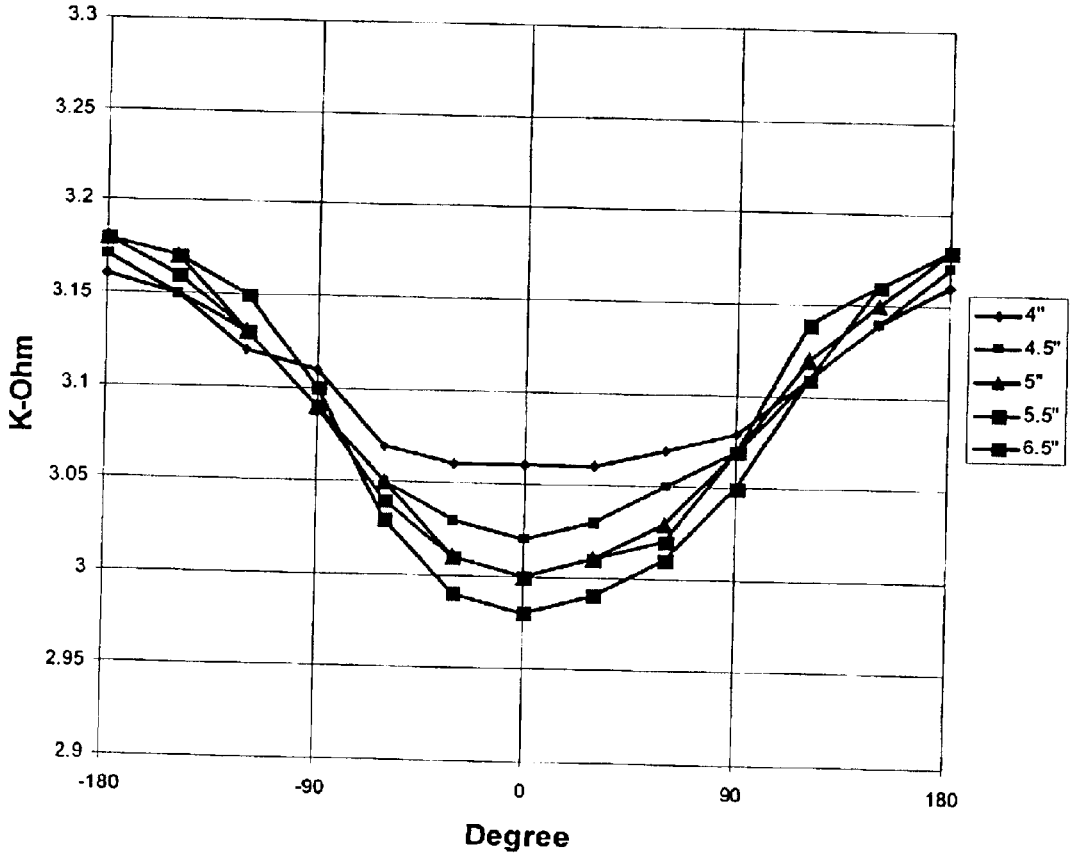
FIG. 10 is a chart showing measurements for different orientations of a device with a magnetic sensor in several different casings.

FIGS. 9 and 10 are charts showing measurements for different orientations of a device with a magnetic sensor in several different casings. The arrangements are similar to those described with respect to FIGS. 7 and 8, respectively, with one difference. A less sensitive GMR is used, but is placed closer to the magnet. The data shows that the resistance still varies, but over a smaller range.

Figure 11:
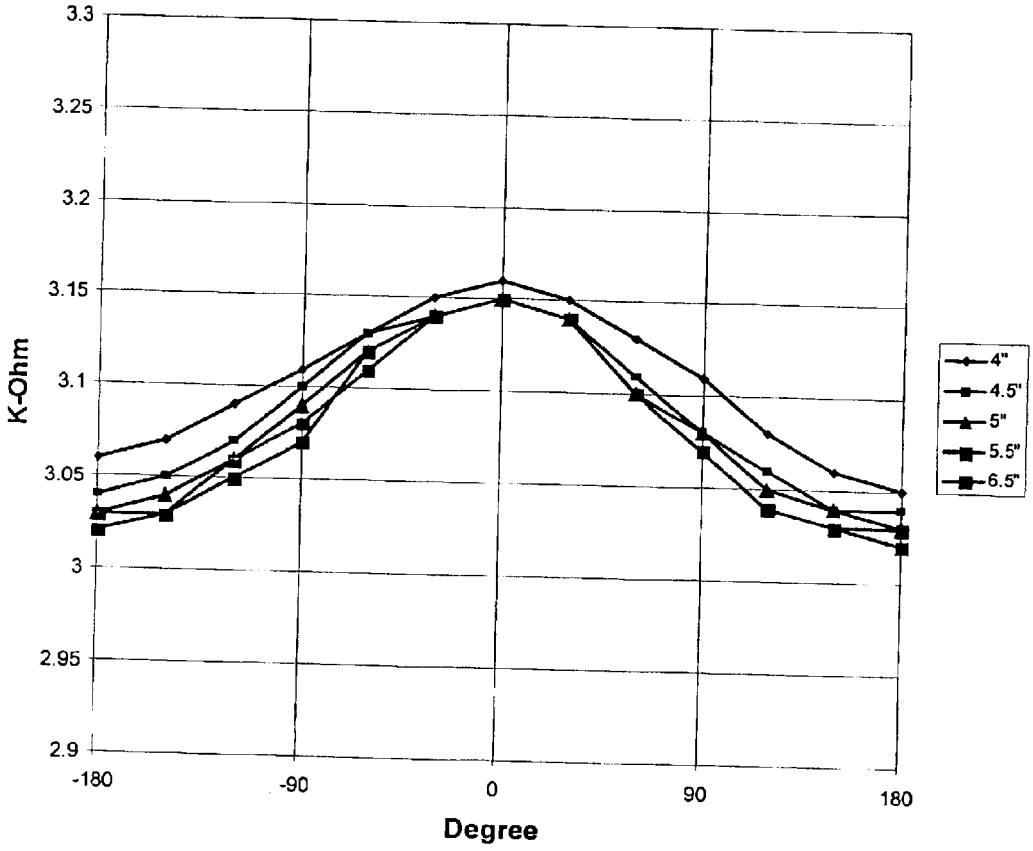
FIG. 11 is a chart showing measurements for different orientations of a device with a magnetic sensor in several different casings.
Figure 12:
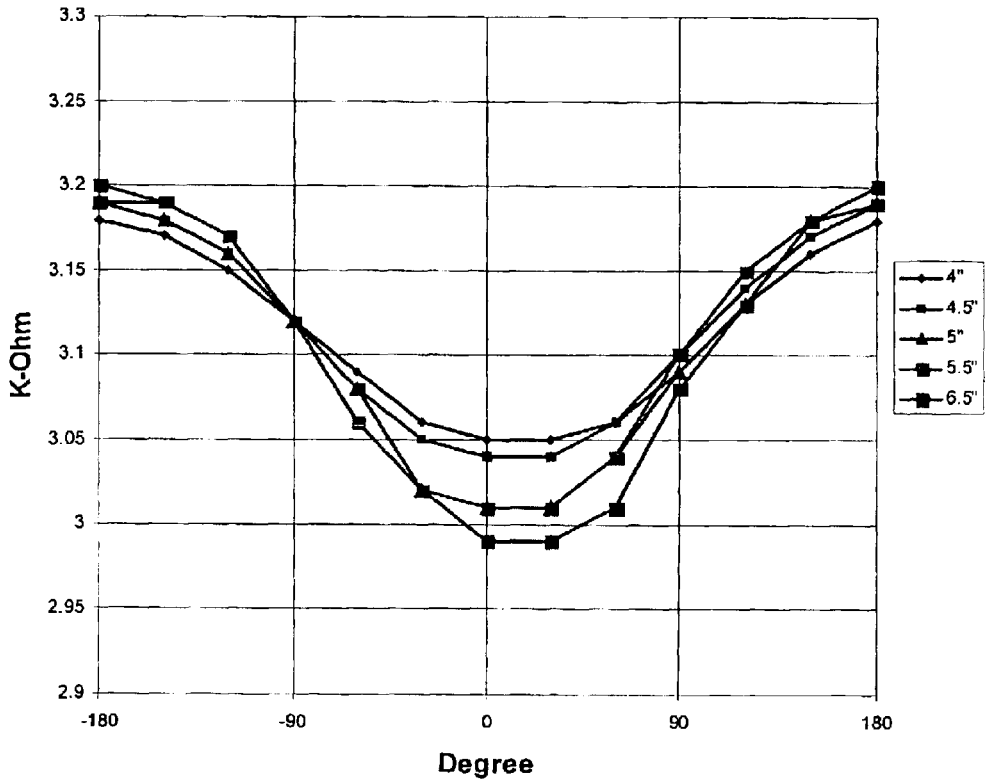
FIG. 12 is a chart showing measurements for different orientations of a device with a magnetic sensor in several different casings.

FIGS. 11 and 12 are charts showing measurements for different orientations of a device with a magnetic sensor in several different casings. The arrangements are similar to those described with respect to FIGS. 9 and 10, respectively, with another, still less sensitive, GMR. Once again, the GMR has been moved closer to the magnet. The resistance varies somewhat less than in FIGS. 7 and 8, but somewhat more than in FIGS. 9 and 10.

The foregoing description of the embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A method for measuring the orientation of a device in a casing, comprising the steps of:

(a) providing a magnetic sensor at a known angular position in the device relative to a functional angle;

(b) lowering the device into the casing, the casing having a bias toward a default angle; and (c) determining the offset from the casing at the known angular position from an output of the magnetic sensor.

2. The method of claim 1 where the device includes at least one perforating charge at the functional angle.

3. The method of claim 1 where the device is a perforating gun and the functional angle is the angle of perforation.

4. The method of claim 1 where the bias toward a default angle in the casing is gravitational settling toward the low side of the casing.

5. The method of claim 1 further comprising the step of:

(d) determining the angular difference between the known angular position and the default angle from the offset.

6. The method of claim 1 where the output of the magnetic sensor is a measurement of magnetic flux density.

7. The method of claim 1 where the device includes a permanent magnet.

8. The method of claim 1 where the casing includes casing collars and further comprising the step of:

(b1) detecting casing collars from the output of the magnetic sensor during step (b).

9. A perforating gun, comprising:

(a) a perforation device oriented to perforate at a functional angle;

(b) a magnetic sensor positioned at a known angle relative to the functional angle;

(c) a magnet positioned in the gun sufficiently proximate the magnetic sensor to bias the magnetic sensor.

10. The perforating gun of claim 9 wherein the magnetic sensor is a giant magnetoresistive field sensor.

11. The perforating gun of claim 9 wherein the device has a center axis and the magnetic sensor has an axis of sensitivity that is parallel to the center axis.

12. The perforating gun of claim 9 wherein the device has a center axis and the magnetic sensor has an axis of sensitivity that is perpendicular to the center axis.

13. The perforating gun of claim 9 wherein the magnetic sensor is a Hall Effect device.

14. The perforating gun of claim 9 wherein the magnetic sensor is a magnetometer.

15. The perforating gun of claim 9 wherein the magnetic sensor includes a wheel with attached magnets.

16. The perforating gun of claim 9 wherein the perforation device is a perforating charge.

17. The perforating gun of claim 9 further comprising a second magnetic sensor at the known angle.

18. The perforating gun of claim 9 wherein the device has a center axis and the magnet has poles and an axis connecting those poles that is parallel to the center axis.

19. The perforating gun of claim 9 wherein the magnet is a permanent magnet.

20. The perforating gun of claim 9 wherein the device has a center axis and the magnet has poles on the center axis.

21. A method for perforating a casing, comprising the steps of:

(a) providing a magnetic sensor at a known angular position in a perforating gun relative to a perforation angle;

(b) lowering the perforating gun into the casing, the casing having a bias toward a default angle;

(c) determining the offset from the casing at the known angular position from an output of the magnetic sensor; and (d) perforating the casing at the perforation angle.

22. The method of claim 21, further comprising the step of:

(c1) rotating the perforating gun.

23. The method of claim 22, wherein step (c1) occurs after step (c).

24. The method of claim 21 where the bias toward a default angle in the casing is gravitational settling toward the low side of the casing.

* * * * *